United States Patent [19]

Jennie

[11] 4,403,436

[45] Sep. 13, 1983

[54] TRIGGER MECHANISM FOR MULTIPLE BARREL FIREARM PROVIDING BARREL SELECTION

[75] Inventor: Fred Jennie, Corona del Mar, Calif.

[73] Assignee: Weatherby, Inc., South Gate, Calif.

[21] Appl. No.: 299,734

[22] Filed: Sep. 8, 1981

[51] Int. Cl.[3] ..... F41C 19/00

[52] U.S. Cl. ..... 42/42 R

[58] Field of Search ..... 42/42 R

[56] References Cited

U.S. PATENT DOCUMENTS

| | | | |
|---|---|---|---|
| 3,537,203 | 11/1970 | Weatherby et al. | 42/42 R |
| 3,786,588 | 1/1974 | Soana | 42/42 R |
| 4,091,556 | 5/1978 | Katseues | 42/42 R |
| 4,310,981 | 1/1982 | Waddell | 42/42 R |

OTHER PUBLICATIONS

Transmittal Letter of Sep. 3, 1981.

*Primary Examiner*—Charles T. Jordan

*Assistant Examiner*—Ted L. Parr

*Attorney, Agent, or Firm*—Herzig & Walsh, Inc.

[57] ABSTRACT

A double barrel firearm provides a selector mechanism so that either barrel can be selected to be fired first. A pair of sears is provided cooperating with hammers. The trigger can actuate either sear that has been selected by the selector mechanism for firing either barrel first. The trigger actuates a connector. The connector can actuate the selected sear. Each sear has engagement with a part of the connector whereby when a sear is actuated, it will move the connector rearwardly, the connector being biased forwardly so that it will then come into a more forward position for engagement with the second sear. Even if the barrel selected to be fired first does not fire, the second barrel will be fired on the second pull of the trigger. The connector also serves as an inertia block so it has the capability of responding to inertia to be repositioned for actuating the second sear in the event the first barrel fires in response to the first pull of the trigger.

11 Claims, 12 Drawing Figures

TRIGGER MECHANISM FOR MULTIPLE BARREL FIREARM PROVIDING BARREL SELECTION

BACKGROUND OF THE INVENTION

1. Field of the Invention

The field of the invention is that of trigger mechanisms for firearms and more particularly a trigger mechanism adapted for use in multi-barrel firearms with selector mechanism whereby the user can make a selection as to which barrel is to be fired first, that is in response to the first pull of the trigger. After the first pull the mechanism resets so that the second pull will fire the second barrel. The mechanism provides the option that the resetting, that is the switch over to the second barrel can be automatic, that is not dependent on actual firing of the first barrel or on the other hand, if the user desires, the resetting can be accomplished by recoil and counter-recoil of an inertia member after the first barrel has actually fired.

2. Background of the Invention

Trigger mechanisms are known in the prior art for use with multi-barrel firearms wherein selector mechanism is provided by means of which the user can select either one of two barrels to be fired first. In known prior art the mechanism utilizes an inertia block responsive to recoil and counter-recoil forces which is integrated into the mechanism in such a way that after the first barrel fires the mechanism sets itself so as to fire the second barrel upon the next pull of the trigger. Mechanisms of this type are shown in U.S. Pat. Nos. 3,537,203 and 3,786,588.

U.S. Pat. No. 3,537,203 also embodies the feature in the trigger mechanism that in the event the first barrel does not fire in response to the pull of the trigger nevertheless the trigger mechanism will reset itself so that the second barrel can nevertheless be fired upon the next pull of the trigger.

The mechanisms referred to above use an inertia member which moves pivotally in response to recoil and counter-recoil forces.

Particularly it is considered that room for improvement existed in the reset or "switch over" mechanism, that is the mechanism whereby after the first pull of the trigger the mechanism is reset or switched over to fire the other barrel. The prior art has been lacking in the provision of the capability of achieving the switch over immediately upon the first pull of the trigger irrespective of whether the selected barrel fires, and further providing the capability which can be optional, of the switch over taking place in response to recoil and counter-recoil resulting from actual firing of the first barrel. The option as identified herein has not previously been available to users.

The herein invention, a preferred exemplary form of which is described in detail hereinafter seeks to realize improvements as identified above.

SUMMARY OF THE INVENTION

The invention relates to a trigger mechanism for multi or double barreled guns, typically shotguns. The trigger mechanism is a type of assembly having separate hammers and sears actuateable by the trigger mechanism. The assembly embodies a manual selector element so that the user can select either one of the barrels to be fired first in response to first actuation of the trigger.

The trigger assembly embodies an improvement in mechanism whereby the trigger mechanism will be reset, so that on the next pull of the trigger, the second barrel will nevertheless be fired. The reset or switch-over takes place even before the released hammer engages its firing pin.

The trigger assembly includes a connector block which after the first barrel is fired, if it does fire, the connector block which has inertia can operate to reset (or "switch over") the mechanism so that on the next pull of the trigger, the trigger will actuate the second sear for firing the second barrel. That is even if due to a malfunction, reset does not take place automatically in resonse to the trigger pull, recoil and counter-recoil acting on the connector block will produce reset.

An improved construction is provided, the connector block embodying construction whereby upon after barrel selection, upon the first pull of the trigger, the sear associated with the hammer for that barrel is caused to act on the connector to move it before the released hammer strikes its firing pin. One end of the sear is constructed to engage a part of the connector block or a member provided on the block so that this sear cams the connector block in a direction that it will normally move in a manner similar to counter recoil movement. The sear itself then moves in a direction to move out of the way to allow the connector block to move forward into a position where it is reset to be engageable with the other sear, so that upon the next pull of the trigger, the other sear operates to fire the second barrel. Thus, it is to be seen that this occurs whether or not the first barrel actually fired or not.

It is to be seen that the operation as described in independent of any recoil or counter-recoil action so that the second barrel can be fired immediately, whether or not the first barrel fires, and of course, this is independent of which barrel is originally selected to be fired. This type of system is preferable to users such as hunters, who desire a high degree of reliability in having the capability of firing a second shot instantly after pulling the trigger for firing the first barrel.

In a preferred form of the invention, a removable cam piece is attachable to the connector block in a position to be engaged by the sear of the selected barrel to move the connector block to accomplish the reset. The cam piece can be removed, in which event the inertia of the connector block will accomplish reset or switch over in response to recoil and counter-recoil resulting from firing of the first barrel as described hereinafter. Thus the user has the option of utilizing the cam piece as described or not.

The connector block is a pivoted member which has lugs or catches which can engage underneath the ends of the sears for actuating the sears to release a hammer for firing. The selector mechanism can move the connector block laterally so that either one or the other of the said lugs will engage one of the sears, that is the selected sear, for firing a corresponding barrel.

When the first selected barrel actually fires, whether the cam piece as described above is in position or not the connector block having inertia will respond to recoil and counter-recoil and will accomplish the reset or switch over. Upon termination of counter recoil, the connector block moves to a position which is further forward than it was before the first barrel was fired.

The connector block has side or lateral grooves providing ledges. When it moves to its further forward position the end of the other sear is engaged on one of the said ledges formed on the block so that on the next pull of the trigger the other sear, that is the other barrel, will be fired. The connector block is carried on the trigger and is normally biased in one direction by a spring.

From the foregoing it is to be observed that the trigger mechanism has the capability when the cam piece is not being used, that in the event one barrel is selected and that barrel fires, the second barrel cannot be prematurely fired, that is, not until recoil and counter-recoil have occurred.

An object is to realize a trigger mechanism as identified in the foregoing embodying a pair of hammers, a pair of sears, a connector block member carried by the trigger and having connector lugs engageable with either of the sears dependently upon the operation of a barrel-selector mechanism, the sears having engagement with the respective hammers whereby upon actuation of sear to release a hammer the sear is further moved by the hammer, and each sear having an end part having engagement with the connector block whereby upon actuation of a sear by a pull of the trigger the sear is moved by the hammer so that the sear end moves the connector block rearwardly and then moves out of the way of the connector block allowing the connector block to come further forward in position for engagement with the other sear whereby the other sear is actuated on the next pull of the trigger.

A further object is to realize a mechanism as in the foregoing object wherein the connector block is provided with a cam formation on its forward surface, the after ends of the sears being configurated to engage the said cam surface so that upon actuation of a sear it acts on the cam surface to move the connector block rearwardly to allow the sear to then move to its original position, after which the connector block spring moves the connector block forward into a position for engagement with the other sear.

DESCRIPTION OF THE PREFERRED EMBODIMENT AND BEST MODE OF PRACTICE OF THE INVENTION

Figure 1:
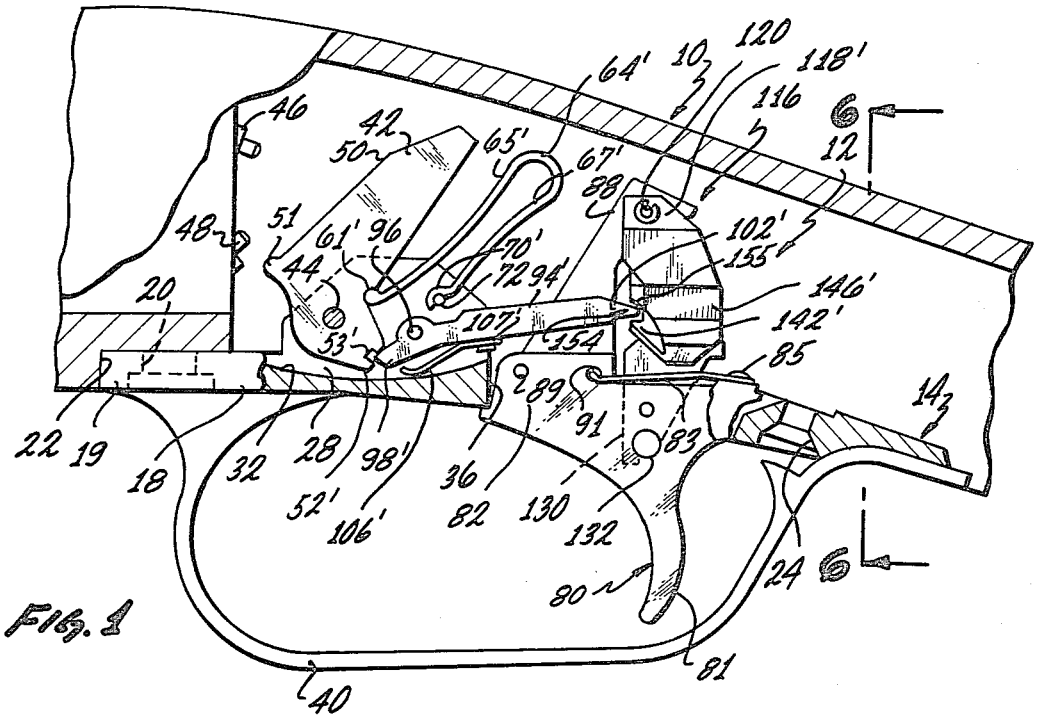
FIG. 1 is a side view partly in section of a preferred form of the invention wherein both of the hammers are cocked and ready to fire.

Referring to FIG. 1 and the other figures of the drawings numeral 10 designates schematically a part of a receiver of a firearm which typically and by way of example may be a double barreled shotgun. On the receiver there may be a typical lever for releasing to break open the action and a safety button, not shown.

The trigger mechanism or assembly is an integral unit as designated at 12 carried by a frame. The trigger mechanism is insertable into a cavity in the receiver 10 and is attachable thereto by screws.

The Frame of the Trigger Mechanism

The parts of the trigger mechanism are carried by a frame which is designated generally by the numeral 14. The configuration of the frame 14 can be seen from FIGS. 1–5 and the isometric views FIGS. 7 and 8. There is a base plate 18 the front end of which is circular as shown at 19 having an aperture 20 to accommodate a screw for fastening to the underside of the receiver in a cutout as shown at 22. The rear end of base plate 18 is shown broken away in FIG. 7. The rear end is shown in the other views, the rear end having an aperture 24 for securement to the receiver.

The frame 14 has upstanding sides at the front end as designated at 26 and 26'. See FIGS. 7 and 8. In between these side members is an upstanding web 28 which extends rearwardly as may be seen in FIG. 2. The web member is between the two hammers as will be described presently. The base 18 on each side of the web 28 has grooves in it as designated at 32 and 32'. These grooves accommodate the movement of the two hammers as will be described presently, the hammers being on opposite sides of the web 28 and inside of the side members 26 and 26'.

The base 18 has an intermediate slot in it as designated at 36 the trigger being mounted in this slot as will be described presently. See FIGS. 7 and 8.

Numeral 40 designates a trigger guard which is a preferably integral with the bottom of the member 18.

Hammer Assembly

Figure 2:
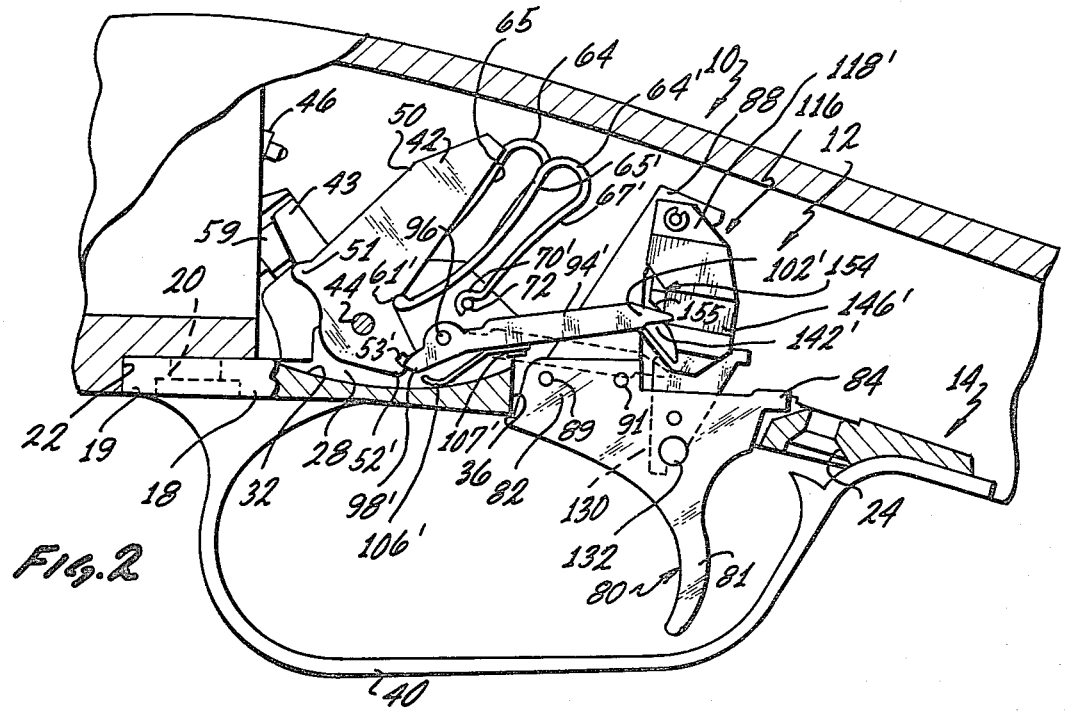
FIG. 2 is a view similar to that of FIG. 1 with one of the hammers engaged against its firing pin in fired position.
Figure 5:
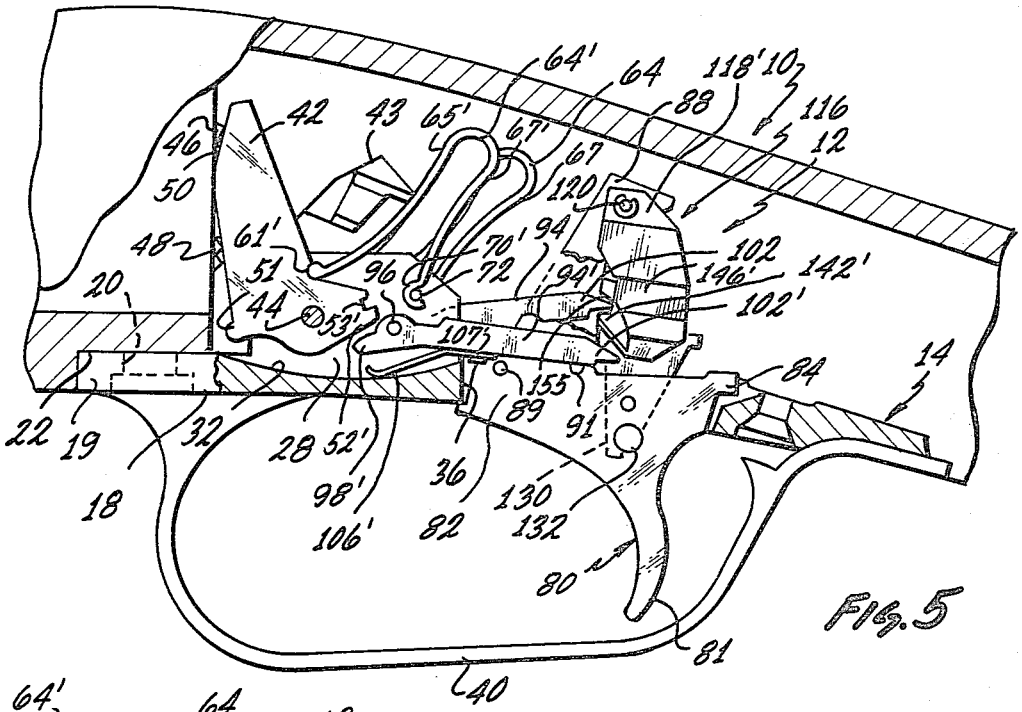
FIG. 5 is a view similar to that of FIGS. 1–4 showing the parts in position with the large hammer fired and against its firing pin.
Figure 7:
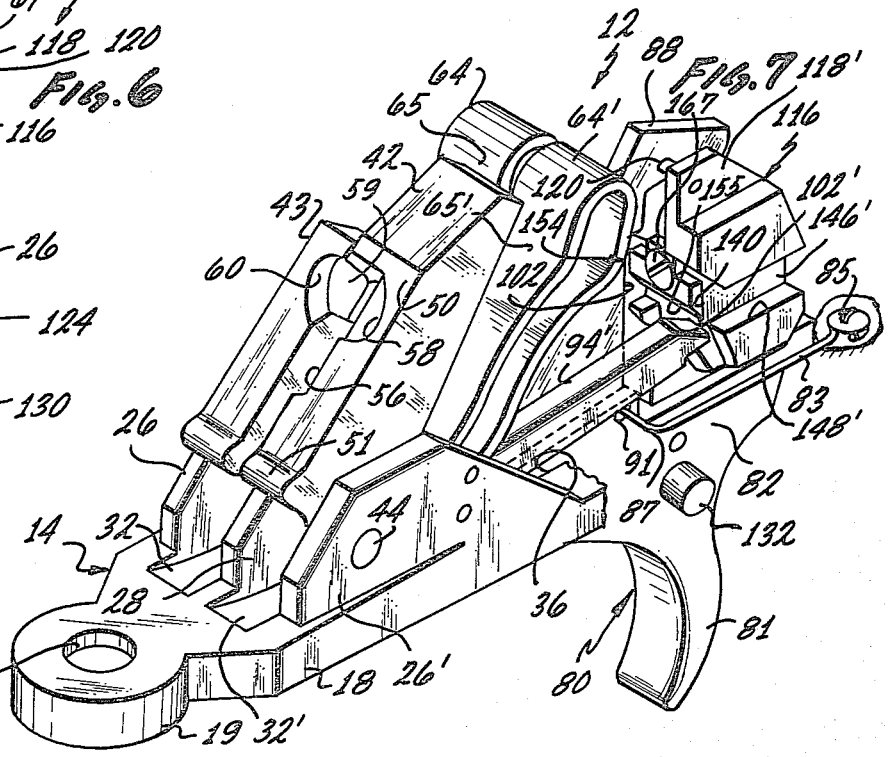
FIG. 7 is an isometric view of the trigger mechanism.

The hammers and hammer springs are best shown in FIGS. 2, 5, and 7. The two hammers are different in construction. The hammer on the left side is designated at 42 and the hammer on the other side is designated at 43. Both hammers are mounted on a cross pin 44 which extends between the side members 26 and 26'. The hammer 42 cooperates with a firing pin 46 and the hammer 43 cooperates with a firing pin 48 as may be seen in the figures.

The hammer 42 has a shape as may be seen in FIG. 2. It has a striking face 50. It has a forwardly extending toe 51 and a rearwardly extending toe 52'. The toe 52' has a notch in it as designated at 53' which is engageable with the toe at the end of a sear as will be described. See FIG. 2.

On the face of the hammer 42 is a cut out or recess 56 and in the surface 50 is an arcuate cutout 58, the bottom surface of which is the part of the hammer that engages the firing pin 46.

The hammer 43 has a different shape than the hammer 42. It is shorter than the hammer 42. On the inside of it, it has an inwardly extending hammer lug 59 and at the front of this lug is an arcuate recess 60 the lug forming the part that comes into engagement with the firing pin 48.

The hammer 42 on the rear side has a small recess 61'. Numeral 64' designates a hairpin type hammer spring having legs 65' and 67' as shown. The end of leg 65' engages in the recess 61' in the hammer 42. At the end of leg 67' is a bent part 70' which engages a pin 72 which extends through the web 28. See FIG. 2.

Numeral 64 designates another similar hairpin hammer spring which is similarly engaged between the hammer 43 and the other end of pin 72. The spring biases the hammers in a counter clockwise direction around the pin or stem 44. The hammer 43 has a notch 53 in it corresponding to the notch 53' for engagement with the other sear as will be described. Hammer 43 has parts like the parts of hammer 42, the numerals for hammer 43 not being primed.

Trigger, Sears, and Connector (Inertia) Block Assembly

Figure 8:
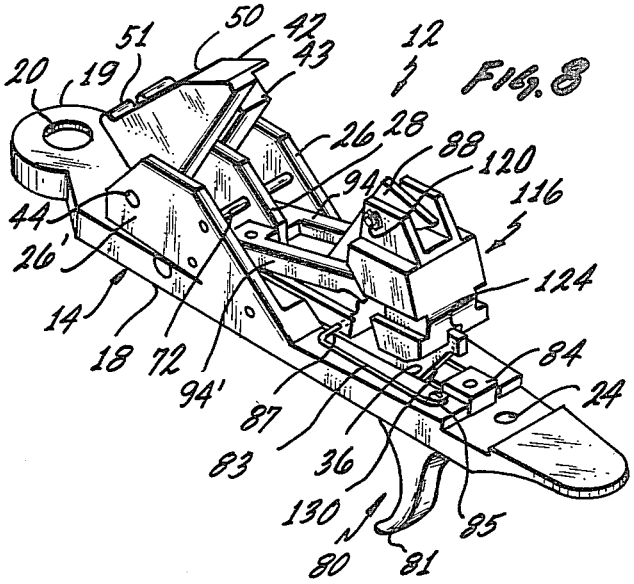
FIG. 8 is another isometric view of the trigger mechanism.

This assembly is shown in FIGS. 1–5, FIG. 6, and the isometric views FIGS. 7 and 8. The trigger as a whole is designated by the numeral 80. The trigger has a shape as may be seen in FIGS. 2 and 7, the trigger including a finger piece 81. The trigger has an intermediate part which fits into the slot 36 this part being designated by the numeral 82. This part fits into the slot 36 the rear end of this part forming a lug as designated at 84.

The forward part of the trigger carries a web member 88 the bottom which fits into a longitudinal slot in the intermediate part 82 of the trigger and is fastened thereto by the pins as shown at 89 and 91, FIG. 2. It may be integral with the trigger.

Numeral 83 in FIG. 7 designates a trigger spring one end of which is fastened to the base 18 by means of screw 85. The other end has a right angle bend in it as shown at 87 and this end extends into a hole 91 in the trigger 80 so as to normally bias it in a clockwise direction.

There are two sears as designated at 94 and 94' which are alike. Both sears are rotatably mounted on a transverse pin 96 which extends through the web 28. See FIG. 5.

As may be seen in FIGS. 1 and 5 for example, the sear 94' has a forwardly extending toe 98' which is engageable in the notch 53' in the hammer 42. The part of the sear 94' that is rearwardly of the pin 96 is longer and it has a tapered toe 102' at its end.

The sear 94' is normally biased in a clockwise direction by means of a bow spring 106' the end of which is secured to the underside of the sear 94' as shown at 107' the spring butting against the bottom of the groove 32' as may be seen in the figures.

The sear 94 is like the sear 94' so the description of it need not be repeated. It cooperates with the other hammer 43 in the same manner as the sear 94' cooperates with the hammer 42.

The trigger cooperates with a connector or inertia block which in turn cooperates with the two sears to accomplish the firing as will be described. The connector block is identified as a whole by the numeral 116. The connector block 116 at the top has two upstanding webs or lugs as designated at 118 and 118'. The upper end of the web 88 carried by the trigger is pinned in between these webs by way of a pivot shaft as designated at 120. See FIG. 6 and FIG. 10.

The bottom of the connector block 116 has a longitudinal intermediate slot in it as designated at 124. See FIG. 6, and FIG. 10.

Figure 6:
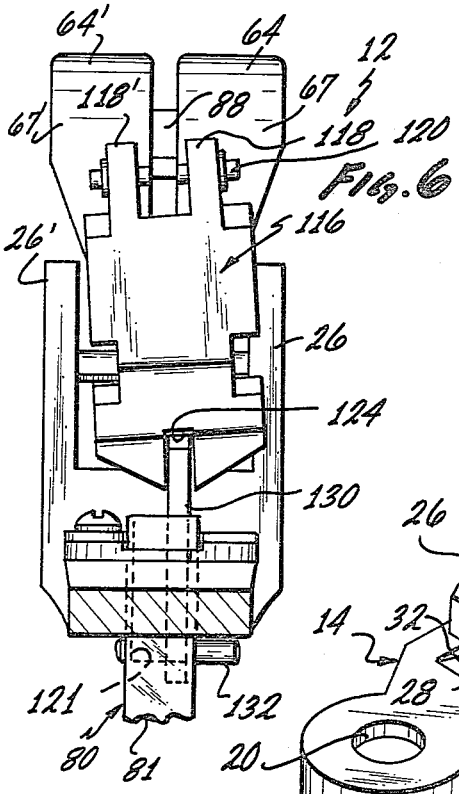
FIG. 6 is a view taken along the line 6—6 of FIG. 1.

The intermediate portion of the trigger 80 at the rear part thereof has an intermediate slot 121 in it. See FIG. 6. Carried in this slot is a selector piece 130 the upper end of which extends into the slot 124 in the bottom of the connector block 116. See FIGS. 2 and 6. Numeral 132 as may be seen in FIG. 6 designates a selector pin or button that extends laterally through the trigger 80 and which is connected to selector piece 130. The selector pin or button can be shifted laterally to one side or the other with respect to the trigger. When it moves it carries the selector piece 130 with it and this cams the connector block 116 from one side to the other by tilting it as illustrated in FIG. 6 wherein the selector pin 132 is moved to the right thereby tilting the lower part of connector 116 to the right. The connector block 116 can pivot about the pivot shaft 120, the slot 124 in its lower part accommodating and permitting sliding movement with respect to the selector piece 130.

Referring again to the connector block 116 its front face is cut back or recessed as shown at 140 and at the lower part of this recess are two forwardly extending lugs or catches 142 and 142', which are on opposite sides of the slot 124, the undersides of these catches slanting rearwardly as shown at 144 and 144'. These lugs or catches cooperate with the toes at the right end of the sears 94 and 94' as will be explained in more detail presently. See FIGS. 1 and 7. On opposite sides of the connector block 116 are grooves as shown at 146 and 146'. The bottom of these grooves form horizontal ledges 148 and 148' which can cooperate with the toes at the ends of the sears as will be described.

Attached to the front face of the connector block 116 in the recess 140 is a cam piece 154 the lower side of which is rearwardly tapered as shown at 155 and which is just above the catches 142 and 142'. The end toes 102 and 102' of the sears 94 and 94' can cooperate with the cam piece 154 in a manner which will be described. Cam piece 154 is attached by the screw 167. See FIG. 9.

Figure 10:
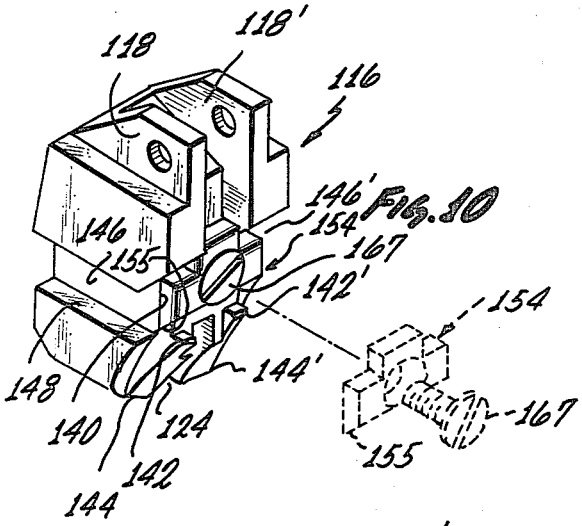
FIG. 10 is an isometric view of the connector block 116, showing the cam piece removed, in outline.

From the foregoing, it will be understood that the trigger mechanism can be operated with the connector piece 154 in position on the connector block 116 as shown in FIG. 10 and as described in the foregoing. On the other hand, the cam piece 154 can be removed as illustrated in FIG. 10, the operation then being as referred to in the foregoing and as described hereinafter.

Figure 11:
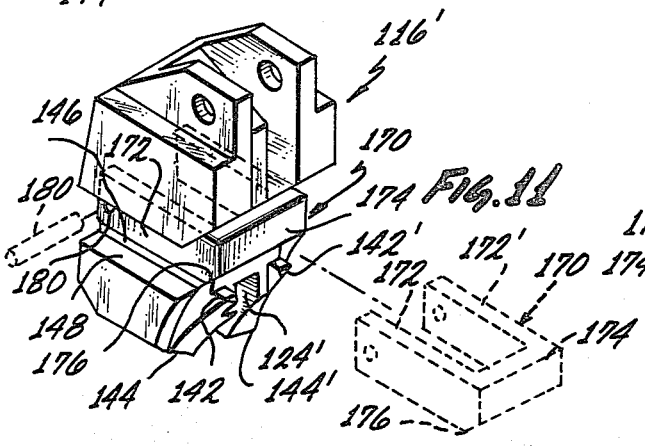
FIG. 11 is an isometric view of the connector block with an alternative modified form of cam piece, the cam piece also being shown removed in outline.
Figure 12:
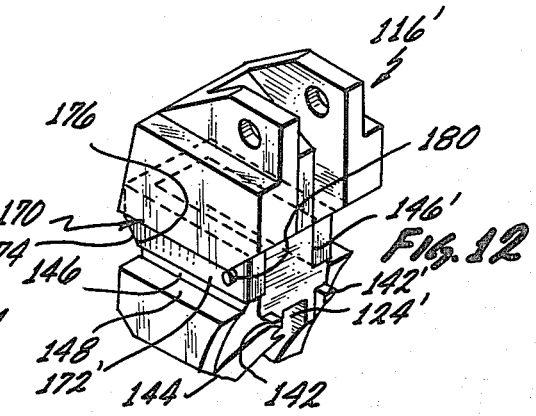
FIG. 12 is an isometric view of the connector block showing the alternative cam piece in reversed position wherein it is inactive.

FIGS. 11 and 12 illustrate an alternative modified form of the cam piece which attaches to the connector block. The connector block in FIGS. 11 and 12 is identified by the numeral 116'. In these figures the cam member or cam piece is the U-shaped member 170 having legs 172 and 172'. The web of the U-shaped member 170 is identified by the numeral 174. Its bottom edge is formed on a slant to provide a cam surface as identified by numeral 176, this can surface corresponding to the surface 155 of the cam piece 154. The U-shaped member 170 is positioned on the block 116; as shown in FIG. 11 being fastened to it by pin 180. In this position it will function in the same manner as described for the cam piece 154. The connector block 116' is just like the previously described block 116 except that the side grooves 146 and 146' are slightly deeper in order to accommodate the legs 172 and 172' of the member 170.

If the shooter desires not to have the option of immediate reset or switch over in response to the first pull of the trigger he removes the U-shaped member 170 but replaces it in a reverse position as shown in FIG. 12. It is fastened in this position by the transverse pin 180. In this position the ends of the legs 172 and 172' compensate for the fact that the grooves 146 and 146' are deeper, the ends of the legs cooperating with the ends of the sears so that the operation is like that previously described, that is the switchover is accomplished only in response to recoil and counter-recoil.

From the foregoing it will be observed that the connector block 116 can be moved laterally by means of the selector pin or button 132. It can also rotate or pivot about the pivot stem 120 in both directions.

Figure 9:
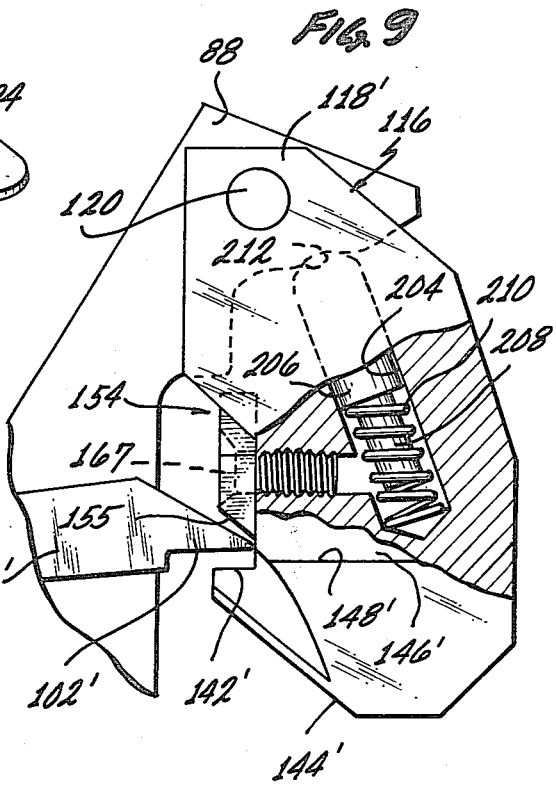
FIG. 9 is an enlarged detail view of the connector block partly in section.

FIG. 9 is an enlarged view of the connector block showing its suspension from the pivot shaft 120. This figure shows the relationship between the catch 142', the end 102' of the sear 94' and the cam piece 154.

As shown in this figure the connector block 116 has a diagonal bore in it as designated at 204. In this bore is a plunger 206 having a small part 208 surrounded by a coil spring 210 which normally urges the plunger 206 outwardly in the bore. The end of the plunger 206 is rounded and is received in arcuate recess 212 provided in a surface of the web member 88. As may be seen therefore the spring 210 normally urges the inertia block 116 forwardly that is in a clockwise direction. The configuration of the inertia block may be readily observed from FIG. 10 and the relationship between the connector block, the trigger, the sears, and the hammers may be further seen in FIG. 8.

DESCRIPTION OF OPERATION

The operation can readily be understood from the following and from reference to the various figures of the drawings.

FIG. 1 shows the trigger mechanism with both hammers in cocked position. The barrel selector button 132 has been shifted to the right as shown in FIG. 6 so that the connector or inertia block 116 is shifted to the right. In this position the catch or lug 142 on the right hand side of the connector block 116 is directly underneath the toe 102 of the sear 94 for actuating it. The sear engages the hammer 43 in the same manner as the sear 94' engages the hammer 42 as previously described. At this time the other catch 142' on the actuator block 116 is not underneath the toe 102' of the other sear 94', because of the position of connector block 116 shifted to the right.

As understood from the foregoing the right hand barrel of the gun has been selected. FIG. 2 shows the position of the parts after the first pull of the trigger which has caused the sear 94 to release the hammer 43 which has been rotated by its hammer spring against the firing pin 48. When the right hand barrel fires, under recoil forces the connector block 116 first tries to move forward and then in response to counter recoil it moves rearwardly and then comes forward again under the influence of biasing spring 210, coming to a position which is further forward as may be seen in FIG. 2. The sear 94 has moved in a clockwise direction as shown in broken lines under the influence of its biasing spring 106 to move out of the way to allow the connector block 116 to come forward as may be seen in FIG. 2. As it comes forward the toe 102' of sear 94' comes into the groove 146' in the inertia block 116 to reset on the ledge 148' at the bottom of this groove. This relationship is shown in FIG. 2. If the trigger 80 is now pulled again, that is for the second time, the inertia block 116 will be lifted, that is moved in a counter clockwise direction, and due to the engagement of the end of the sear 94' in the groove 146' the sear will release the hammer 42 which will come into engagement with the firing pin 46.

As will be understood the foregoing describes the operation wherein a barrel is selected to be fired first; the trigger is pulled to fire that barrel which does fire; and the switch over or resetting so that upon the second pull of the trigger after the first barrel has fired the second barrel will fire.

Figure 3:
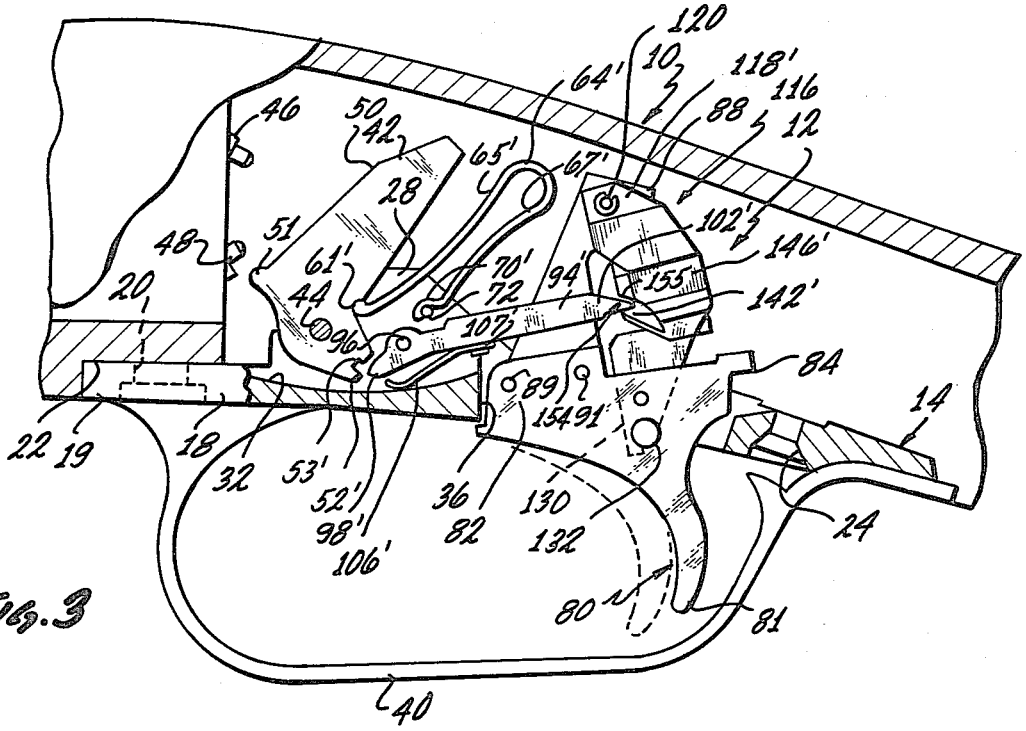
FIG. 3 is a view similar to that of FIGS. 1 and 2 showing the trigger pulled for releasing the larger hammer.
Figure 4:
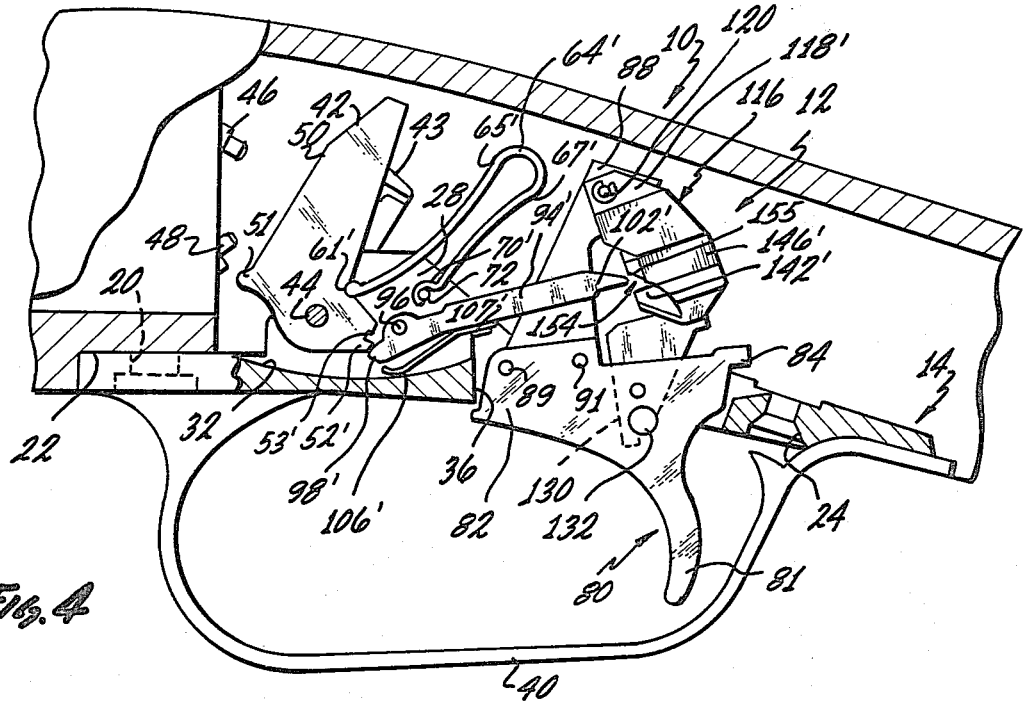
FIG. 4 is a view similar to that of FIGS. 1, 2, and 3 showing the parts in a slightly advanced or further position from that of FIG. 3.

FIGS. 3, 4 and 5 illustrate the resetting action when the first barrel is selected, upon a first pull of the trigger, before the first barrel fires or when that barrel does not fire. Upon the first pull, the connector block 116 is moved so as to accomplish the switch over, that is to reset the trigger mechanism for immediate firing of the second barrel on the second pull of the trigger. It will be understood that when reset has occurred in this manner, and a barrel is fired, recoil and counter recoil action on the connector block move it but reset as already occurred.

FIGS. 3, 4, and 5 illustrates the mechanism with the selector pin 132 moved to the left for firing the left hand barrel, that is, for releasing the hammer 42. In this position of the parts the catch 142' on the inertia block 116 is underneath the toe 102' of the sear 94'. Upon the first pull of the trigger rearwardly as shown in FIG. 3 the sear 94' is lifted to release its toe 98' from the notch 53' in the hammer 42. The hammer 42 will now begin to move under the influence of its hammer spring toward its firing pin 46 as illustrated in FIGS. 3, 4, and 5. It will be observed in FIGS. 3 and 4 that the toe 102' of sear 94' is in engagement with the slanting cam surface 155 on the bottom of cam piece 154 attached to the front of the inertial block 116. As soon as the hammer 42 is released and starts moving in a counter clockwise direction its toe part 52' engages the toe 98' of the sear 94' rotating that sear in a counter clockwise direction so that its toe 102' by reason of its engagement with the slanting cam surface 155 on cam piece 154 rotates the connector block 116 in a counter clockwise direction as illustrated in FIGS. 3 and 4 against the force of its biasing spring 210. As the connector block 116 is rotated in a counter clockwise direction it then allows the sear 94' to drop down, that is, to rotate in a clockwise direction as illustrated in FIG. 5 under the influence of its biasing spring 106' to get out of the way and allow the connector block 116 to come forward again, that is in a clockwise direction under the influence of its biasing spring to a position sufficiently forward that toe 102 of the other (right hand) sear 94 now comes into the groove 146 on the other side, that is, the right hand side of the connector block 116 with the toe 102 on the ledge 148 formed at the bottom of this groove. Thus the parts are now in a position such that upon a second pull of the trigger the connector block will be moved to engage and actuate sear 94 to release the other hammer 43, switch over takes place by reason of the camming action on the connector block 116 which is immediately reset for firing the second barrel upon the next pull of the trigger. The reset takes place before hammer 42 reaches its firing pin. Thus if the first barrel fires, reset has already taken place before recoil and counter-recoil act on connector block 116.

Referring to the alternative form of the cam piece shown in FIGS. 11 and 12, the reset operation occurs in the manner already described.

From the foregoing, it will be understood that the cam piece shown in FIG. 10 and that in FIGS. 11 and 12 will bring about the immediate reset or switch over from the first barrel for firing the second barrel. Thus users that prefer to have this immediate capability have the option of using the cam piece as described. For users that do not wish to have this option, but who prefer to have the operation of the resettor switch-on occur in response to recoil and counter recoil, can simply remove the cam piece in the manner already described. In that event, they are assured of the capability that the second barrel cannot be prematurely fired until recoil and counter-recoil have occurred. It should be understood that the invention is intended to embrace the alternatives or equivalents as disclosed as well as other equivalent alternatives or modifications.

From the foregoing, those skilled in the art will readily understand the nature and construction of the invention and the manner in which it achieves and realizes its purposes, especially the objects as set forth in the foregoing.

The foregoing disclosure is representative of a preferred form of the invention and is to be interpreted in an illustrative rather than a limiting sense. The invention is to be accorded the full scope of the claims appended hereto it being intended that the claims cover a reasonable range of equivalents. Individual components or elements of the combination may be modified but still related in a manner so that the combination has the particular specific capabilities defined in the foregoing, it being intended that such changes in elements be within the spirit and scope of the invention.

I claim:

1. A firearm having double barrels and a trigger mechanism including a trigger, a hammer for each barrel, a sear for each hammer, connector means actuateable by the trigger and engageable with an individual sear for releasing its respective hammer, barrel selector means cooperative with the connector means for selecting an individual barrel to be fired by positioning of the connector means, said connector means being constructed to be moveable laterally by the selector means for a position for engagement with a first sear to a second position for engagement with a second sear, said connector means also being moveable in a forward direction from a position for engagement with a first sear to a position for engagement with a second sear, each sear and its respective hammer having a constructional relationship whereby after sear releases its hammer, the hammer rotates the sear, and means providing for engagement of each sear with the connector means whereby rotation of the sear causes movement of the connector means rearwardly to disengage it from the sear and means to move the connector means to a more forward position for engagement with the second sear.

2. A firearm as in claim 1 said last means including biasing means for each sear for producing movement of the sear to a position allowing movement of the connector means to the said more foreward position.

3. A firearm as in claim 2 wherein said connector means includes an inertia block moveable in response to recoil and counter-recoil to a reset position whereby the trigger may fire a second barrel, the said inertia block having a part positioned to be engageable by either of the sears whereby either sear can be actuated by its respective hammer to cause movement of the inertia block for resetting the said block for firing the second barrel.

4. A firearm as in claim 1 wherein said connector means is in the form of a pivotally mounted block, said block being moveable to said more forward position by said biasing means.

5. A firearm as in claim 1 wherein the said connector means is in the form of an inertia block having a construction whereby on firing of the first selected barrel in response to recoil and counter-recoil the connector means is moved to its more forward position for engagement with the second sear.

6. A firearm having double barrels and a trigger mechanism including a trigger, a hammer for each barrel, a sear for each hammer, connector means actuateable by the trigger and engageable with an individual sear for releasing its respective hammer, barrel selector means cooperative with the connector means for selecting an individual barrel to be fired by positioning of the connector means, said connector means being constructed to be moveable laterally by the selector means from a position for engagement with a first sear to a second position for engagement with a second sear, said connector means also being moveable in a forward direction from a position for engagement with a first sear to a position for engagement with a second sear, each sear and its respective hammer having a constructional relationship whereby after a sear releases its hammer, the hammer rotates the sear, and means providing for engagement of each sear with the connector means whereby rotation of the sear causes movement of the connector means to a more forward position for engagement with the second sear, the connector means having a part positioned to be engageable by the end of either sear to be moved by the sear to a position for engagement with the other sear.

7. A firearm as in claim 6 wherein said part is attached to the connector.

8. The firearm as in claim 7 wherein the said U-shaped part is constructed whereby it can be attached to the said connector means in a reverse position wherein it is inactive but wherein the connector means can respond to recoil and counter-recoil for resetting for firing second barrel.

9. A firearm as in claim 7 wherein said attached part, when removed, the connector means will respond only to recoil and counter-recoil for firing the second barrel.

10. A firearm as in claim 6 wherein said connector means has grooves on opposite sides thereof positioned to engage the end of the sear when the connector is in its forward position, the said part being U-shaped having legs, whereby the part can be attached to the connector means with the legs in the said grooves.

11. A firearm having a double barrel and a trigger mechanism including a trigger, a hammer for each barrel, a sear for each hammer, connector means actuateable by the trigger and engageable with an individual sear for releasing its respective hammer, barrel selector means cooperative with the connector means for selecting an individual barrel to be fired by positioning of the connector means, said connector means being constructed to be moveable laterally by the selector means from a position for engagement with a first sear to a second position for engagement with a second sear, said connector means also being moveable in a forward direction from a position for engagement with a first sear to a position for engagement with a second sear, each sear and its respective hammer having a constructional relationship whereby after a sear releases its hammer, the hammer rotates the sear, and means providing for engagement of each sear with the connector means whereby rotation of the sear causes movement of the connector means to a more forward position for engagement with the second sear, said connector means including an inertia block moveable in response to recoil and counter-recoil to a reset position wherein the trigger may fire a second barrel, the said inertia block having a part positioned to be engageable by either of the sears whereby either sear can be actuated by its respective hammer to cause movement of the inertia block for resetting the said block for firing the second barrel, each sear having a portion having a relationship to its respective hammer whereby upon release of the hammer a further movement is imparted to the sear, the said inertia block part having a cam formation engageable with the ends of said sears whereby rotating movement of a first sear imparted by a hammer causes the inertia block to move in recoil and counter-recoil directions into a reset position whereby the second barrel can be fired.

* * * * *